United States Patent [19]

Wiget et al.

[11] 4,430,007

[45] Feb. 7, 1984

[54] METHOD OF REDUCING THE POWER CONSUMPTION OF THE STEPPING MOTOR OF AN ELECTRONIC TIMEPIECE AND AN ELECTRONIC TIMEPIECE EMPLOYING THE METHOD

[75] Inventors: Fridolin Wiget, Neuchatel; Yves Guerin, Granges, both of Switzerland

[73] Assignee: ETA S.A. Fabriques d'Ebauches, Switzerland

[21] Appl. No.: 291,391

[22] Filed: Aug. 10, 1981

[30] Foreign Application Priority Data

Aug. 25, 1980 [CH] Switzerland ..... 6381/80

[51] Int. Cl.[3] ..... G04B 19/00; G04C 3/00

[52] U.S. Cl. ..... 368/157; 368/76; 368/85; 368/202; 368/218

[58] Field of Search ..... 368/76, 80, 160, 219, 368/10, 11, 202, 717, 28, 204, 85-86, 155-157, 217-218; 318/132, 696, 717, 138, 254, 317

[56] References Cited

U.S. PATENT DOCUMENTS

| | | | |
|---|---|---|---|
| 3,500,103 | 3/1970 | Swain et al. | 318/132 X |
| 3,855,781 | 12/1974 | Chihara et al. | 318/717 X |
| 4,114,364 | 9/1978 | Takahashi | 368/202 X |
| 4,158,287 | 6/1979 | Nakajima et al. | 368/202 |
| 4,204,397 | 5/1980 | Asano et al. | 368/202 |
| 4,223,522 | 9/1980 | Nomura et al. | 368/80 X |
| 4,281,405 | 7/1981 | Besson et al. | 368/76 X |
| 4,283,783 | 8/1981 | Nakajima et al. | 368/218 X |
| 4,321,519 | 3/1982 | Ueda et al. | 368/10 X |
| 4,321,520 | 3/1982 | Ueda et al. | 368/11 X |
| 4,321,521 | 3/1982 | Ueda et al. | 368/11 X |
| 4,351,039 | 9/1982 | Berney | 368/86 X |
| 4,367,049 | 1/1983 | Laesser et al. | 368/76 |

FOREIGN PATENT DOCUMENTS

| | | | |
|---|---|---|---|
| 54-21874 | 2/1979 | Japan | 368/85 |

*Primary Examiner*—J. V. Truhe
*Assistant Examiner*—Terry Flower
*Attorney, Agent, or Firm*—Allegretti, Newitt, Witcoff & McAndrews, Ltd.

[57] ABSTRACT

The present invention comprises measuring, upon application of a drive pulse to the actuating coil 5 of the stepping motor, the variation in the magnetic induction flux in the stator of the motor, and interrupting the drive pulse when the variation in flux reaches a predetermined value. Measurement of the variation in flux may be effected, for example, by detecting the current in the actuating coil and integrating the difference between the supply voltage of the actuating coil and the product of the current by the d.c. resistance of the coil, or by providing an auxiliary detection coil 71 and integrating the voltage induced therein in an integrator 73, 74. When the integrator outputs exceeds the magnitude of either a positive or negative reference voltage, a comparator circuit 78, 79, 81 provides the signal to a circuit 13 to terminate the drive pulse.

The foregoing abstract is not to be taken as limiting the invention described herein, and in order to understand the full nature and extent of the technical disclosure herein, reference should be made to the accompanying drawings and detailed description.

13 Claims, 8 Drawing Figures

METHOD OF REDUCING THE POWER CONSUMPTION OF THE STEPPING MOTOR OF AN ELECTRONIC TIMEPIECE AND AN ELECTRONIC TIMEPIECE EMPLOYING THE METHOD

BACKGROUND OF THE INVENTION

The invention concerns a novel method for reducing the power consumption of the stepping motor of an electronic timepiece. The invention also relates to an electronic timepiece employing the method.

In electronic timepieces which comprise a stepping motor for driving the display means, the major part of the power supplied by the electrical power source, which is generally a battery, is consumed by the motor. It is therefore important to limit the power consumption of the motor to the minimum level, in order to increase the service life of the battery or so as to be able to decrease the size of the battery, for a given service life.

In most of the present-day electronic timepieces, the motor receives drive pulses, by way of an excitation circuit, from a shaping circuit which is supplied with low-frequency signals by a frequency divider circuit associated with an oscillator which forms the time base. The duration of the pulses is fixed and is selected so as to ensure proper operation of the motor under the worst conditions, viz, low battery voltage, driving the calendar mechanism, shocks, etc. The motor therefore is over-supplied for most of the time.

The power consumption of the motor can be reduced substantially by adapting the power of the drive pulses to its instantaneous load and to its supply voltage.

One known solution comprises providing a pulse shaping circuit which is capable of producing pulses of different durations, and a device which detects rotary movement or the absence of rotary movement of the motor. The duration of the drive pulses applied to the motor is progressively reduced until the fact that a step has not been made is detected. A catch-up pulse is then applied to the motor and the power of the normal drive pulses is fixed at a higher value. That value is maintained for a certain period of time. If the motor has rotated normally during that period of time, the duration of the pulses is again reduced. Such a design does not permit permanent and rapid adaptation of the drive pulses to the motor load. Moreover, this slow mode of adaptation, and the application of catch-up pulses in the event of non-rotation, means that the power consumption is at a higher level than necessary.

Also known are circuits for controlling stepping motors, comprising means for detecting the movement of the rotor during application of the drive pulse and for interrupting that pulse when the rotor has performed its step movement or at least has rotated through a sufficient distance or has acquired a sufficient speed, to conclude that step.

For example, in U.S. Pat. No. 3,500,103, the movement of the movable member of the motor is detected by way of the voltage induced in a detection coil, and the drive pulse is interrupted when the movable member reaches either a given position or a given speed. Now, in order to effectively go on to conclude its step movement, the rotor, at the end of the drive pulse, must be in a given position and must have acquired a certain speed. Therefore, there are conditions required in respect of position, speed and motor torque, in order to interrupt the drive pulse. If only a single condition is imposed, the range of operation of the motor is restricted or, in contrast, if the condition imposed is not necessary, it is to the detriment of the level of power consumption that the control system operates.

The designs proposed in this prior patent therefore do not make it possible to optimize the duration of the drive pulses in dependence on the load and the supply voltage of the motor.

The designs proposed in U.S. Pat. No. 3,855,781, wherein the position of the rotor is detected by measuring the voltage induced in an auxiliary coil or a voltage produced by deformation of piezoelectric sensor in response to the passage of the teeth of one of the wheels of the gear train which is driven by the motor, give rise to the same disadvantages.

French Pat. No. 2,200,675 proposes detecting the variation in current in the actuating coil of the motor and interrupting the drive pulse when that current passes through a minimum value which corresponds to a maximum value in respect of the induced voltage. The limits of this detection operation are imposed by the shape of the current which depends on the time constant of the circuit, the back e.m.f. induced, and the load on the motor. In certain cases, the current minimum may disappear, which makes the control device ineffective. These disadvantages are in addition to those already mentioned hereinabove in relation to the other designs.

Moreover, U.S. Pat. No. 4,114,364 describes a circuit for controlling the duration of the drive pulses in dependence on the load of the motor, which comprises means for detecting the current in the actuating coil and means for interrupting the pulse when that current reaches a value which is equal to the ratio between the supply voltage of the coil and its d.c. resistance, that is to say, when the rotor has concluded its step movement. Also, envisaged is the possibility of interrupting the pulse before the current has reached that value. In this case also, only one positioning condition is imposed, for the control action.

BRIEF SUMMARY OF THE INVENTION

The object of the present invention is to provide an improved method which makes it possible to reduce the power consumption of the stepping motor of an electronic timepiece, by automatically adapting the duration of the voltage drive pulses applied to the motor, to its load and to its supply voltage, and to avoid the disadvantages of the solutions proposed hitherto.

According to the present invention there is provided a method for reducing the power consumption of the stepping motor of an electronic timepiece, by automatically adapting the width of the voltage drive pulses supplied to the motor, to its load and to its supply voltage, the motor comprising at least one actuating coil, a stator and a rotor which rotates through a given angle when a voltage drive pulse is applied to the actuating coil, comprising the steps of measuring, during each voltage drive pulse, the variation in the magnetic induction flux in the stator, and interrupting the voltage drive pulse when this variation in flux reaches a predetermined value.

The predetermined value can be so selected as to be between a minimum value in respect of the variation in flux necessary to cause the rotor to rotate, and a maximum value which is attained when the rotor concludes its step movement, so as to provide an optimum compromise between the useful torque capable of being produced by the motor, and its power consumption.

The invention also concerns an electronic timepiece for carrying out the method and which comprises an oscillator for producing a standard frequency signal, a frequency divider circuit which is connected to the oscillator to produce a low-frequency time signal, a stepping motor comprising at least one actuating coil, a stator and a rotor, a supply circuit for periodically producing and supplying voltage drive pulses to the actuating coil in response to the time signal, and monitoring means for controlling the supply circuit so as automatically to adapt the width of the pulses to the load and to the supply voltage of the motor, the monitoring means comprising a measuring device for measuring, in respect of each voltage drive pulse, the variation in the magnetic induction flux in the stator, and producing a measuring signal representing the value of the variation in flux, and means responsive to the measuring signal to apply to the supply circuit, a signal for interrupting the voltage drive pulse when the variation in flux reaches a predetermined value.

BRIEF DESCRIPTION OF THE DRAWINGS

The invention will be better appreciated by reference to the following description and the accompanying drawings relating thereto, given by way of example. In the drawings.

DETAILED DESCRIPTION OF THE PREFERRED EMBODIMENTS

Figure 1:
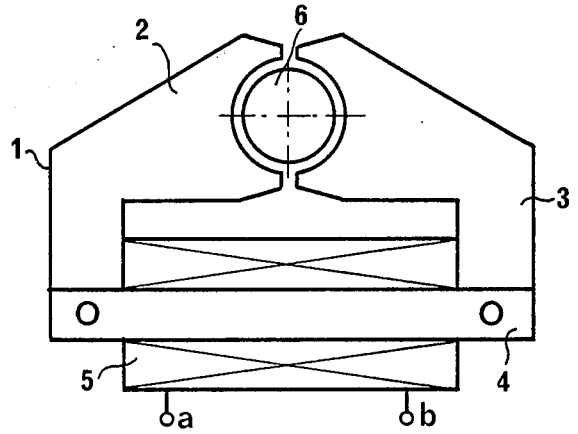
FIG. 1 is a diagrammatic cross-sectional view of a stepping motor of a type commonly used in electronic timepieces.

FIG. 1 is a diagrammatic view of a stepping motor which is frequently used in electronic timepieces. This motor is a motor having two stable positions, requiring bipolar drive pulses.

The motor comprises a stator 1 formed by two pole pieces 2 and 3 which are joined together by a yoke 4 having a high degree of magnetic permeability and around which is wound the actuating coil 5, and a rotor 6 which comprises a permanent magnet.

The rotor 6 rotates through an angle of 180°, always in the same direction, each time that a voltage drive pulse is applied to the terminals a and b of the coil 5. The pulses which are periodically received by the motor are of alternate polarity.

Figure 2A:
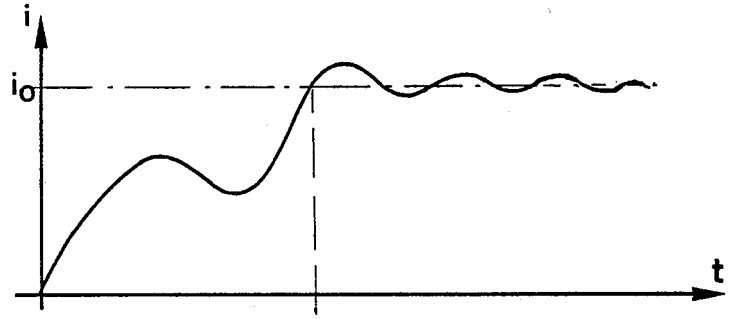
FIGS. 2*a*, 2*b* and 2*c* are curves which respectively show the variation in time of the current in the actuating coil of the motor, the difference between the voltage at the terminals of the actuating coil and the product of the d.c. resistance of the coil by the current flowing through the coil, and the variation in the magnetic induction flux in the stator.

FIG. 2*a* shows the variation in the current i in the actuating coil 5 versus time when a drive pulse is applied to the motor. When the rotor 6 rotates, a back e.m.f. is induced in the coil 5. Accordingly, the current i which begins by increasing, decreases at the expiry of a certain period of elapsed time and increases again subsequently. When the rotor 6 passes for the first time through a stable equilibrium position which is displaced through 180° with respect to the position that it occupied at the moment at which the drive pulse was applied, the current is equal to $i_o = V/R$ in which V denotes the supply voltage and R denotes the d.c. resistance of the coil. After having reached the above-indicated value $i_o$, the current oscillates about that value until the rotor is stabilized in its rest position.

Figure 2B:
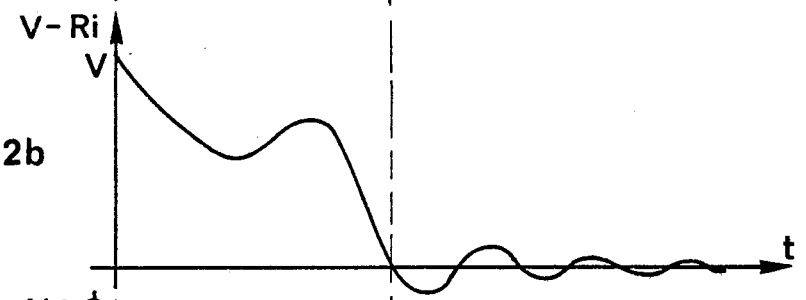

The corresponding variation in the quantity V-Ri, representing the voltage induced in the actuating coil except for the sign, is shown in FIG. 2*b*.

Figure 2C:
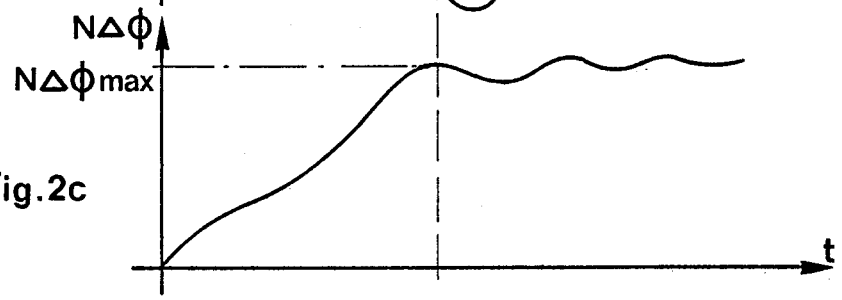

FIG. 2*c* shows the variation with time of the product of the variation in the magnetic induction flux $\Delta\phi$ in the core 4 of the actuating coil with the number N of turns of the coil.

This quantity is given by:

$$N\Delta\phi(t) = \int_o^t (V - Ri)dt = - \int_o^t edt$$

and it progressively rises and passes through a first maximum $N\Delta\phi_{max}$ when the current i reaches the value $i_o$.

Figure 3:
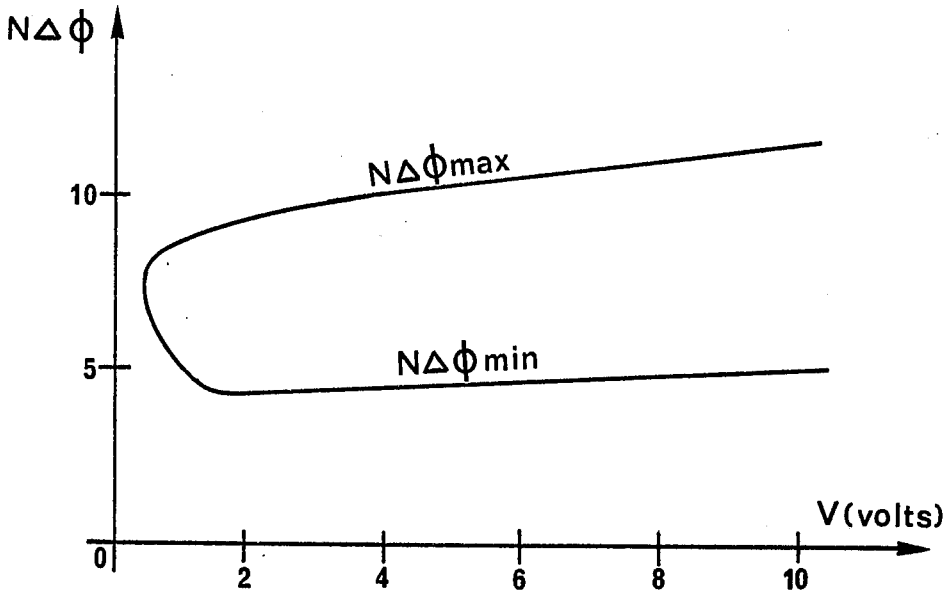
FIG. 3 is a graph showing the minimum flux variation required to drive the rotor and the maximum flux variation attained when the motor passes through its equilibrium position for the first time in dependence on the voltage applied to the actuating coil of a motor such as the motor shown in FIG. 1.
Figure 5:
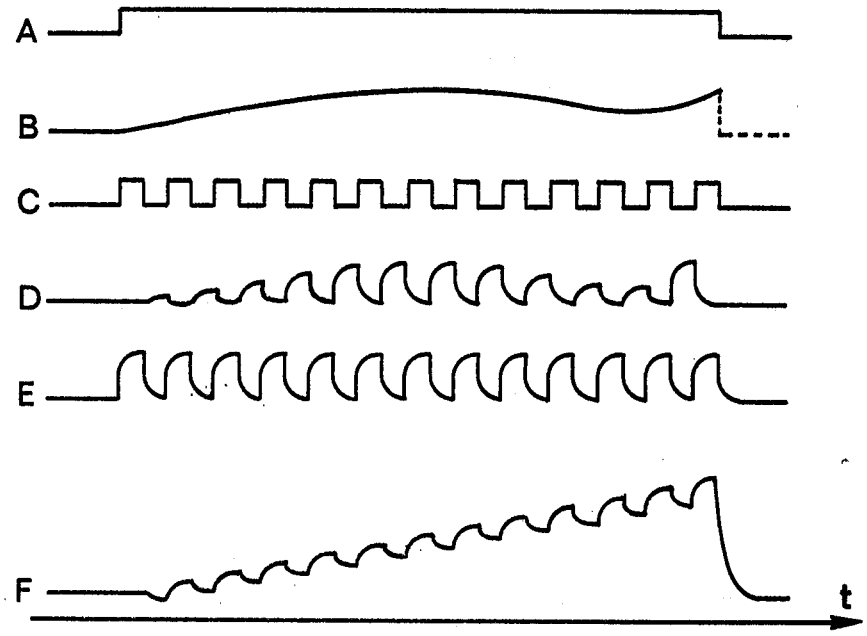
FIG. 5 is a diagram showing the shape of the signals which occur at different points in the circuit of FIG. 4.

In order for the stepping motor to operate correctly, the flux variation must reach a certain value $\Delta\phi_{min}$ which depends on the load on the motor but which, as shown in FIG. 3, depends very little on the supply voltage.

The duration of the drive pulse can therefore be automatically adapted to the load of the motor and to its supply voltage by measuring the variation in flux in the core of the coil from the moment at which the drive pulse is applied, and interrupting that pulse when the variation in flux reaches a predetermined value.

The predetermined value is selected so as to be between the values $\Delta\phi_{min}$ and $\Delta\phi_{max}$ so as to produce an optimum compromise between the useful torque capable of being produced by the motor for driving the display means and the consumption thereof, and to ensure proper operation of the motor over a wide range of supply voltages.

The above-mentioned predetermined value may be for example equal to about 75% of the value $\Delta\phi_{max}$ corresponding to supply voltages of the order of 1.5 or 2 V.

The operation of determining the value in respect of the variation in induction flux may be performed by integrating the voltage induced in the actuating coil itself, or in a detection coil provided on the motor. One method for determining the variation in the induction flux from the voltage induced in the actuating coil comprises detecting the current in the coil during application of the drive pulse and integrating the difference V-Ri.

Figure 4:
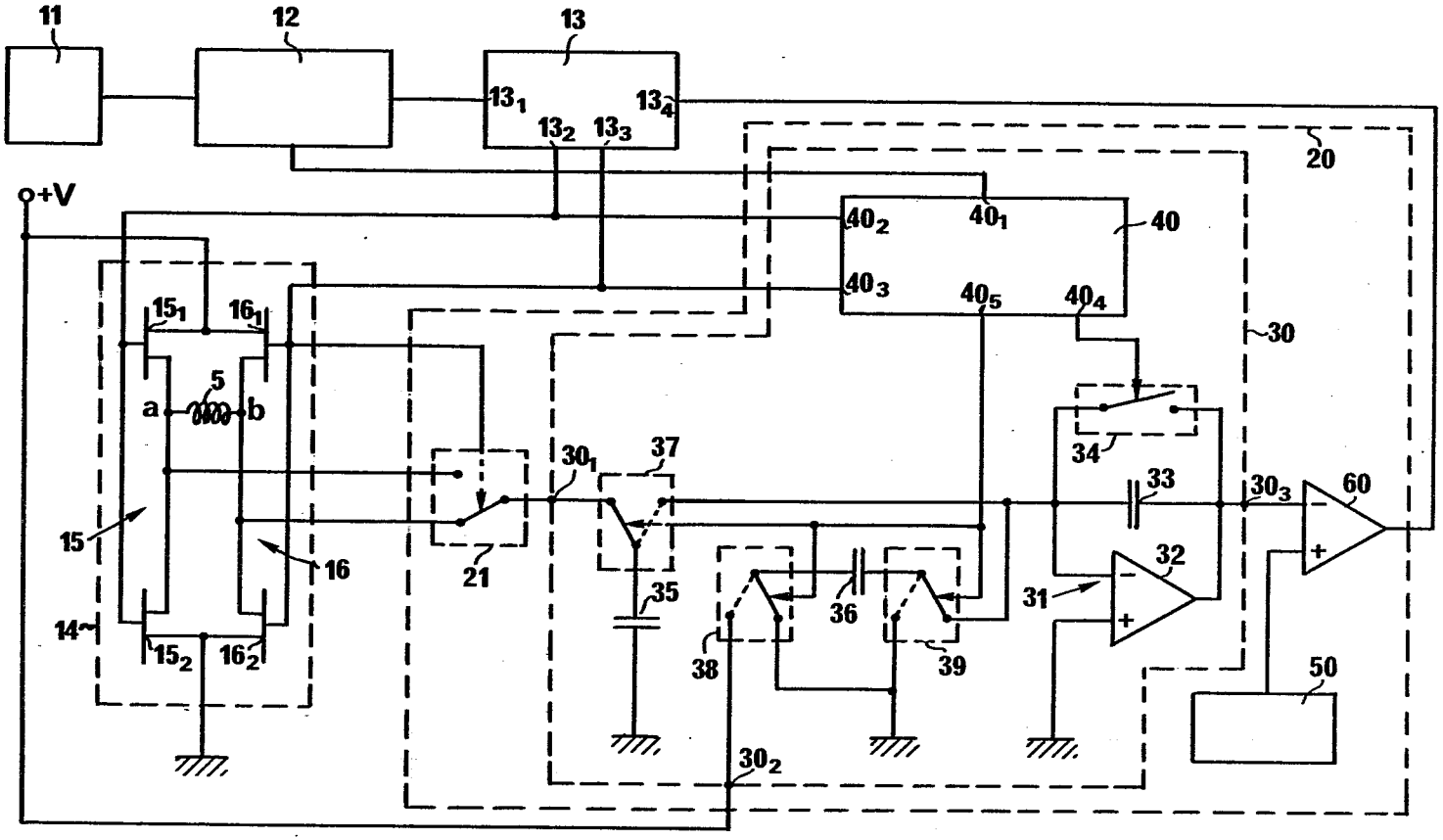
FIG. 4 is a block and circuit diagram of a first illustrative embodiment of the electronic circuit of a timepiece according to the invention.

FIG. 4 shows an embodiment of the electronic circuit of a timepiece according to the invention, wherein the value of the variation in the induction flux is measured by detecting the current i in the actuating coil 5 and calculating the integral of the difference V-Ri.

An oscillator 11 supplies a standard frequency signal, for example at a frequency of 32 kHz, to a frequency divider circuit 12 which comprises a series of flip-flops connected in a cascade arrangement, which supplies a signal at a frequency of 1 Hz at its output. This low-frequency signal is transmitted to a first input $13_1$ of an actuating pulse generating circuit 13. The generating circuit 13 is arranged to produce pulses at its outputs $13_2$ and $13_3$, the beginning and the end of the pulses being respectively determined by the signal originating from the frequency divider circuit and by the occurrence at its second input $13_4$ of a signal from a monitoring circuit 20. The circuit 13 which need not be described in detail herein may comprise any known type of pulse shaping circuit for producing actuating pulse of a sufficient duration, for example 7.8 ms, to ensure that the motor can operate under the worst conditions, and a circuit comprising for example flip-flops and NAND-gates for interrupting the pulses when it receives a signal from the monitoring circuit 20.

The monitoring circuit which is described in detail hereinafter calculates the integral of the difference V-Ri and, at its output, produces a signal for interrupting the actuating pulse for driving the motor, when the value of the above-mentioned integral attains a predetermined value.

The signals which occur at the outputs $13_2$ and $13_3$ of the circuit 13 and which each have a period of two seconds and which are phase-shafted by one second relative to each other are applied to the actuating circuit 14 which, with the pulse generating circuit 13, forms the supply circuit of the motor. The actuating circuit 14 conventionally comprises two inverters 15 and 16, the inputs of which are connected to the outputs $13_2$ and $13_3$ of the pulse generating circuit, while the outputs thereof are connected to the terminals a and b of the actuating coil 5 of the motor.

The sources of two p-channel MOS transistors $15_1$ and $16_1$, which are connected to the positive terminal of the d.c. supply voltage source (not shown) used in the timepiece, are at potential +V, while those of two n-channel MOS transistors $15_2$ and $16_2$, which are connected to the negative terminal of the source, are at potential 0.

When no actuating pulse occurs at the outputs $13_2$ and $13_3$ which are then at logic level 0, the transistors $15_1$ and $16_1$ are in a conducting condition, while the transistors $15_2$ and $16_2$ are non-conducting, and the coil 5 is virtually short-circuited. When a signal appears at the output $13_2$, the transistor $15_1$ becomes non-conducting while the transistor $15_2$ becomes conducting; a current i then passes into the actuating coil 5 and the motor begins to rotate. When the output $13_2$ reverts to level 0 upon the occurrence of an actuating signal for interrupting the drive pulse at the input $13_4$ of the circuit 13, the transistor $15_2$ becomes non-conducting, the transistor $15_1$ becomes conducting again and the drive pulse is interrupted. The same situation occurs in regard to the transistors $16_1$ and $16_2$ which are controlled by the signal at the output $13_3$ with a current of opposite direction in the coil 5.

The circuit 20 comprises a calculating circuit 30 having an input $30_1$ which can be connected, by way of an electronic switch 21 which is controlled by the signal appearing at the output $13_3$ of the pulse generating circuit 13, either to the output of the inverter 16 when the transistors $15_1$ and $16_2$ are in a conducting condition or to the output of the inverter 15 when the transistors $16_1$ and $15_2$ are in a conducting condition. The switch 21 could be controlled by the signal appearing at the output $13_2$ instead of the signal at the output $13_3$. Another input $30_2$ of the circuit 30 is connected to the positive terminal of the supply voltage source.

The calculating circuit 30 which will be described in detail hereinafter calculates the value of the integral of the difference V−Ri and, and its output $30_3$, produces a voltage which is representative of that value. The monitoring circuit 20 further comprises a circuit 50 for producing a reference voltage corresponding to the predetermined value of the variation in the induction flux, at which the voltage drive pulse is to be interrupted. The circuit 50 may comprise for example a voltage divider which is connected between the terminals of the supply voltage source or a Zener diode. The outputs of the calculating circuit 30 and the circuit 50 are connected to the inverting and non-inverting inputs respectively of a comparator circuit 60. As soon as the output voltage of the calculating circuit 30 reaches or exceeds the value of the reference voltage, the output logic level of the comparator circuit 60 changes. That signal, being transmitted to the input $13_4$ of the circuit 13, causes the voltage drive pulse applied to the actuating coil 5 to be interrupted.

The calculating circuit 30 comprises an integrating circuit 31 including an operational amplifier 32 whose non-inverting input is connected to earth, that is to say, to the negative terminal of the supply voltage source, and capacitor 33 which is connected between the inverting input and the output of the operational amplifier, that output also forming the output $30_3$ of the calculating circuit. An electronic switch 34 disposed in parallel with the capacitor 33 permits the capacitor to be discharged when the switch is closed.

The calculating circuit further comprises two capacitors 35 and 36 and three electronic switches 37, 38 and 39. These switches, which are shown in symbolic form in the drawing, comprise MOS transistors. The switch 37 makes it possible to connect the capacitor 35, which is otherwise connected to earth, either to the input $30_1$ of the calculating circuit or to the input of the integrating circuit 31, while the switches 38 and 39 permit the capacitor 36 to be connected either between earth and the input of the integrating circuit, or between the input $30_2$ of the calculating circuit and earth.

A circuit 40 which is connected on the one hand to an intermediate output of the voltage divider circuit 12 for receiving a high-frequency signal, for example, at a frequency of 16 kHz, and, on the other hand, to the actuating pulse generating circuit 13, for example, to its outputs $13_2$ and $13_3$, as shown in the drawing, combines the signals that it receives at its inputs $40_1$, $40_2$ and $40_3$ in order on the one hand to provide at its output $40_4$, a signal for actuating the switch 34 so that the switch 34 remains in an open condition throughout the duration of a drive pulse and is in a closed condition at other times, and on the other hand, to apply simultaneously to the three switches 37, 38 and 39 which are connected to its output $40_5$, the periodic high-frequency signal that it receives from the dividing circuit 12, between the moment at which a drive pulse is applied to the motor and the moment at which that pulse is interrupted. The circuit 40 may be formed, for example, by an OR-gate whose inputs and output respectively form the inputs $40_2$, $40_3$ and the output $40_4$ and an AND-gate of which one input is connected to the output of the OR-gate and of which the other input is connected to the voltage divider circuit, the output of the AND-gate forming the output $40_5$ of the circuit. Since the switch 34 remains closed during the period for which no drive pulse is applied to the actuating coil 5, it would be possible for the switches 37, 38 and 39 to be permanently actuated by directly applying the high-frequency signal thereto, but such an arrangement would increase the power consumption of the circuit.

For the following description of the mode of operation of the calculating circuit 30, reference may be made to the diagram of FIG. 4, in which:

A denotes the drive pulse applied to the actuating coil;

B denotes the saturation voltage of the transistor $15_2$ or $16_2$ which is conducting, depending on the polarity of the drive pulse;

C denotes the periodic high-frequency signal for actuating the switches 37, 38 and 39;

D denotes the voltage across the capacitor 35;

E denotes the voltage across the capacitor 36; and

F denotes the voltage at the output of the integrating circuit 31.

For the sake of clarity, the period of the signal for actuating the switches has been considerably exaggerated in FIG. 4.

When the actuating coil 5 receives a drive pulse, the saturation voltage of the conducting transistor $15_2$ or $16_2$ is applied to the input $30_1$ of the calculating circuit 30 by way of the switch 21. That voltage is proportional at any moment to the current i in the coil.

From the moment at which the drive pulse is applied to the coil, the high-frequency signal which occurs at the output $40_5$ of the circuit 40 simultaneously actuates the switches 37, 38 and 39. When the switches are in the positions shown in solid lines in the drawing, the capacitor 35 is charged to the input voltage of the calculating circuit, while the capacitor 36 which is charged to the supply voltage V during the preceding half-period of the high-frequency signal, during which the switches were in the positions shown in broken line, is discharged, with reversal of the sign of the charge, into the capacitor 33. When the switches go into the position shown in broken line, the capacitor 35 is discharged into the capacitor 33 while the capacitor 36 is re-charged to the voltage V.

The charge accumulated in the $j^{th}$ cycle of the high-frequency actuating signal by the capacitor 35 is equal to:

$$Q_{1j}=C_1Ki_j$$

in which $C_1$ denotes the value of the capacitor 35, K denotes the constant in respect of proportionality between the saturation voltage of one or other of the transistors $15_2$ and $16_2$ and the current which passes through it, and $i_j$ is the value of the current in the coil at the moment of said $j^{th}$ cycle, while the charge accumulated by the capacitor 36, of value $C_2$, remains equal to $$Q_2=C_2V.$$

After N cycles, the charge accumulated by the capacitor 33, of value $C_3$, is:

$$Q_3=\sum_{j=1}^{N} C_2V - C_1Ki_j$$

the voltage at the output of the integrating circuit 31 is then equal to:

$$V_S=\sum_{j=1}^{N} \frac{C_2V}{C_3} - \frac{C_1Ki_j}{C_3}$$

As care is taken to use a very high frequency (16 kHz) for the signal for actuating the switches 37, 38 and 39, the capacitors $C_1$, $C_2$ and $C_3$ may be so selected that the voltage $V_S$ is virtually equal to the integral of the difference $V-Ri$.

The circuit of FIG. 4 can be easily integrated, using MOS technology. On the same chip, the ratios between the values of the capacitors are defined by the ratios of the surface areas thereof, which can be easily controlled.

Moreover, on the same chip, the resistive characteristics of the MOS transistors are very close. The proportionality coefficient K is therefore virtually the same for the transistors $15_2$ and $16_2$.

Figure 6:
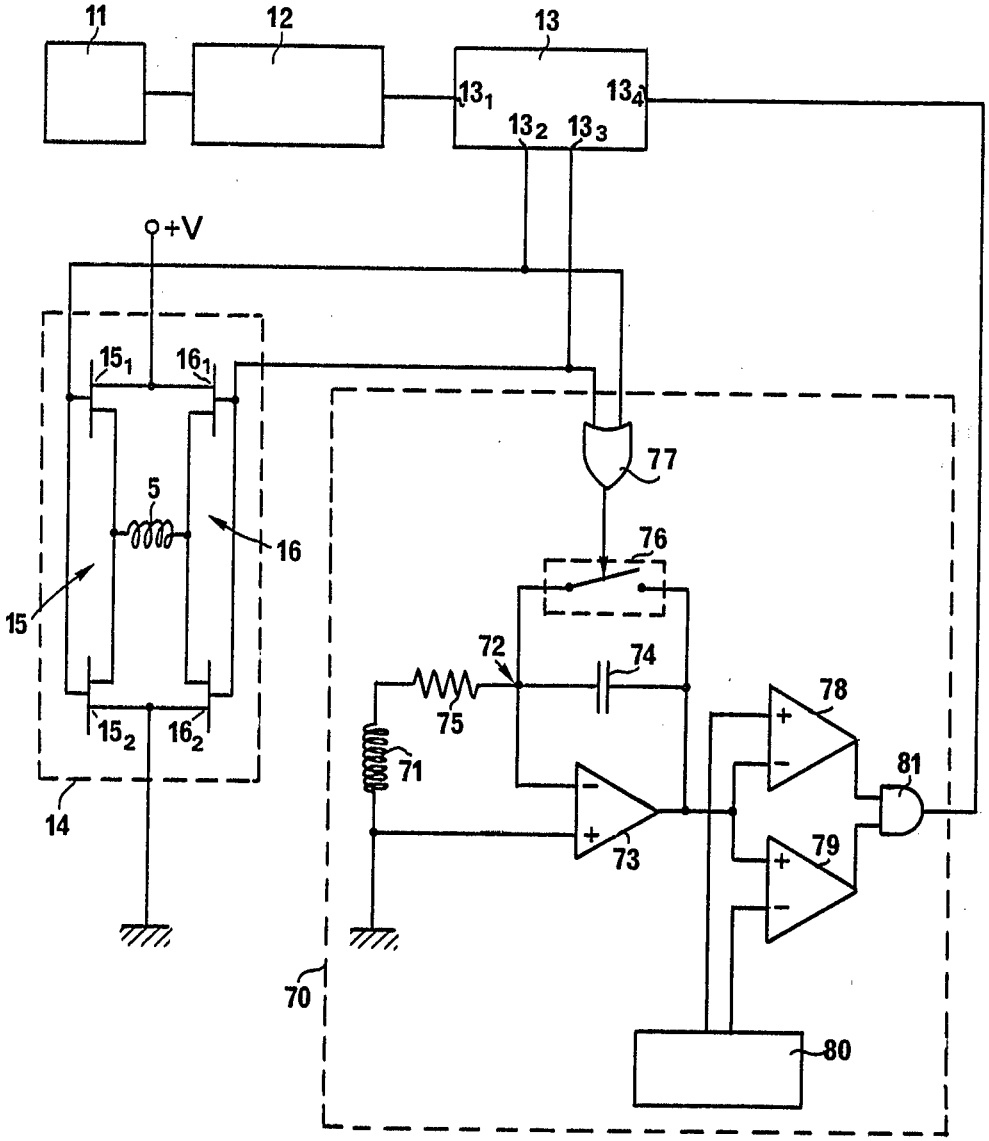
FIG. 6 is a block and circuit diagram of a second illustrative embodiment of the electronic circuit of a timepiece according to the invention.

FIG. 6 shows a second illustrative embodiment in respect of the electronic circuit of the timepiece according to the invention, wherein the variation in the magnetic induction flux is measured by integrating the voltage induced in a detection coil.

The yoke 4 (see FIG. 1) of the motor then carries in addition to the actuating coil 5, a further winding (not shown in FIG. 1) comprising n turns, which serves as a pick-up coil.

The circuit shown in FIG. 6, comprises an oscillator 11, a frequency divider circuit 12, a supply circuit 13, 14 of the motor, which are identical to those of the circuit in FIG. 4, and a monitoring circuit 70.

The monitoring circuit 70 comprises a measuring circuit including the detection coil 71 and an integrator circuit 72, to the input of which the coil 71 is connected and which is conventionally formed by an operational amplifier 73, a capacitor 74 which is connected in parallel with a circuit-breaker switch 76 between the output and the inverting input of the amplifier, and a series resistor 75. The switch 76 is actuated by way of an OR-gate 77, by means of the signals which occur at the outputs $13_2$ and $13_3$ of the circuit 13, still in such a way as to be in an open condition while the drive pulses are applied to the actuating coil 5, and closed for the rest of the time. The voltage induced in the detection coil 71 being alternately positive and negative depending on the polarity of the drive pulse, two comparators 78 and 79 are provided in this circuit arrangement, to compare the output voltage of the integrator to the reference voltage $V_{REF}$. The inverting input of the comparator 78 and the non-inverting input of the comparator 79 are connected to the output of the integrator 72. The non-inverting input of the comparator 78 which is connected to a first output of a reference voltage generating circuit is at a positive potential $+V_{REF}$, while the inverting input of the comparator 79 which is connected to a second output of the circuit 80, comprising for example voltage dividers, is at a potential $-V_{REF}$. The outputs of the two comparators are connected to the inputs of an AND-gate 81, the output of which is connected to the input $13_4$ of the actuating pulse generating circuit 13.

Thus, as long as the output voltage of the integrator 72 remains lower, in absolute value, than the reference voltage, the output of the AND-gate is at logic level 1; when the output voltage becomes higher than $+V_{REF}$ or lower than $+V_{REF}$, the output of the gate 81 goes to logic state 0, thereby causing interruption of the drive pulse. It would also be possible to use only a single comparator and a reference voltage generator which provides only a positive voltage, by providing a rectifying circuit producing a uni-directional detection signal, between the coil 71 and the integrator 72.

The circuit shown in FIG. 6 has certain advantages over the circuit shown in FIG. 4: it makes it possible to do without adjustment of the values of the ratios between the capacitors $C_1$, $C_2$, and $C_3$ to simulate the resistance of the actuating coil; moreover, operation of the circuit is virtually insensitive to temperature variations, in contrast to the above-described circuit in which the current in the actuating coil was detected, by way of the saturation voltage of a transistor. On the other hand, the circuit shown in FIG. 6 makes it necessary to provide input terminals for the detection coil 71 on the integrated circuit.

It will be appreciated that the present invention is obviously not limited to the above-described illustrative embodiments. For example, the reference voltage generating circuit and the comparator circuit or circuits may be replaced by threshold devices, in particular, MOS transistors.

Moreover, a stepping motor which has two stable positions and which is actuated by bipolar pulses was selected only by way of example. The method according to the invention applies to other types of motors which can be used in an electronic timepiece. The circuits described hereinbefore may be readily adapted to the type of motor used. For example, if the motor is one which is supplied by pulses of the same polarity and which rotates only in a single direction, the actuating pulse generating circuit 13 will provide a 1 Hz frequency signal at a single output, and that signal may be applied to the gate of a control transistor which is connected in series with the actuating coil between the terminals of the supply voltage source. It will be possible to detect the current in the coil, by tapping off the voltage between drain and source of that transistor or at the terminals of a resistor which is of low value relative to the resistance of the coil 5, being mounted in series with the coil 5 and the transistor. The actuating pulses may be applied directly to the circuit breaker switch 34 and the circuit 40 will be limited to an AND-gate, the inputs of which will be connected to the intermediate output of the frequency divider 12 and to the output of the circuit 13. The reference voltage generating circuit 50 will have to produce a suitable voltage for this type of motor.

As regards the circuit shown in FIG. 6, adaptation thereof will be even easier. The circuit 13 will be modified in the same manner as in regard to the circuit of FIG. 4, and likewise for the actuating circuit 14 which will be limited to a transistor in series with the actuating coil 5. As regards the monitoring circuit 70, it will be possible to omit the gate 77 and for the actuating pulses of the circuit 13 to be directly applied to the switch 76. There will be only a single comparator, to an input of which will be applied the reference voltage produced by the generating circuit 80.

Another advantage of the circuit of FIG. 6 relative to the circuit of FIG. 4, which should be noted, is that the reference voltage may be fixed. Indeed, the number of turns of the detection coil 71 may be adapted to each type of motor in order to produce the desired variation in flux, at which the drive pulse is to be interrupted.

Finally, it also is possible to measure the variation in the induction flux in the stator, by chopping the voltage drive pulse applied to the actuating coil which is then alternately supplied with high-frequency pulses and in an open circuit mode, by collecting the voltage at the terminals of the coil when it is in an open circuit condition, and integrating that voltage.

While specific illustrative embodiments of the present invention have been described for purposes of example, other modifications will be apparent to those skilled in the art. It therefore is intended that the scope of the present invention be limited solely by the scope of the appended claims.

What is claimed is:

1. A method for reducing the power consumption of the stepping motor of an electronic timepiece, by automatically establishing the width of voltage drive pulses supplied to the motor, in accordance with its load and its supply voltage, the motor comprising at least one actuating coil, a stator and a rotor which rotates through a given angle when a voltage drive pulse is applied to said actuating coil, comprising the steps of measuring, during each voltage drive pulse, the variation in the magnetic induction flux in the stator, and interrupting the voltage drive pulse when this variation in flux reaches a predetermined value.

2. A method according to claim 1, wherein the predetermined value is between a minimum value in respect of the variation in induction flux necessary to cause the rotor to rotate, and a maximum value which is attained when the rotor has rotated through the said given angle.

3. A method according to claim 1 or 2, wherein the variation in the induction flux in the stator is measured by the steps of detecting the current in the actuating coil and integrating the difference between the supply voltage of the motor and the product of the current with the d.c. resistance of the coil.

4. A method according to claim 1 or 2, wherein the motor has a detection coil and wherein the variation in the induction flux is measured by integrating the voltage induced in the detection coil.

5. An electronic timepiece comprising an oscillator for producing a standard frequency signal, a frequency divider circuit which is connected to the oscillator to produce a low-frequency time signal, a stepping motor, comprising at least one actuating coil, a stator and a rotor, a supply circuit for periodically producing and supplying voltage drive pulses to the actuating coil in response to the time signal, and monitoring means for controlling the supply circuit for automatically establishing the width of the drive pulses in accordance with the value of the load and the supply voltage of the motor, the monitoring means comprising a measuring device for measuring, in respect of each voltage drive pulse, the variation in the magnetic induction flux in the stator and producing a measuring signal representing the value of the variation in flux, and means responsive to the measuring signal to apply to the supply circuit, a signal for interrupting the voltage drive pulse to establish its width when the variation in flux reaches a predetermined value.

6. An electronic timepiece according to claim 5, wherein the means for applying the signal for interrupting the voltage drive pulse comprise means producing a reference signal corresponding to the predetermined value of the variation in flux, and means for comparing the measuring signal to the reference signal.

7. An electronic timepiece according to claim 5 or 6, wherein the predetermined value is between a minimum value in respect of the variation in flux required to cause the rotor to rotate, and a maximum value which is attained when the rotor has rotated through the said given angle.

8. An electronic timepiece according to claim 5 wherein the measuring device comprises means for detecting the current in the actuating coil and a calculating circuit which receives a voltage proportional to the detected current and the supply voltage of the motor at first and second inputs respectively, and is arranged to calculate the integral of the difference between the supply voltage and the product of the current by the d.c. resistance of the actuating coil.

9. An electronic timepiece according to claim 8, wherein the calculating circuit comprises first and second capacitors, an integrating circuit including a third capacitor and a first electronic switch connected across the third capacitor, a second electronic switch for connecting the first capacitor alternately to the first input of the calculating circuit and to the input of the integrating circuit, a third electronic switch for connecting the second capacitor alternately to the second input of the calculating circuit and to the input of the integrating circuit, and a circuit which is connected to the supply circuit and to the frequency divider circuit in order to control opening of the first electronic switch for the period of each voltage drive pulse, and also to control, at least during the period of each voltage drive pulse, the second and third switches by a periodic high-frequency signal such that the first and second capacitors are alternately charged, at the frequency of the high-frequency signal, respectively to the voltage which is proportional to the current in the actuating coil and to the supply voltage of the coil, and discharge alternately into the third capacitor, the charges transferred from the first and second capacitors into the third capacitor being of opposite sign.

10. An electronic timepiece according to claim 8 wherein the voltage which is proportional to the current in the actuating coil, applied to the first input of the calculating circuit, is the saturation voltage of a transistor which is connected in series with the actuating coil.

11. An electronic timepiece according to claim 10, wherein the stepping motor is a motor having two stable positions, to the actuating coil of which are applied voltage drive pulses of alternate polarity, by way of two inverters, and wherein the transistor which is connected in series with the actuating coil is the conducting transistor of one of the inverters.

12. An electronic timepiece according to claim 5 wherein the measuring device comprises a detection coil which is coupled to the stator and an integrating circuit for integrating the voltage induced in the detection coil.

13. A method for reducing the power consumption of the stepping motor of an electronic timepiece to its load and to its supply voltage, the motor comprising at least one actuating coil, a stator and a rotor which rotates through a given angle when a voltage drive pulse is applied to said actuating coil, comprising the steps of:

applying a drive pulse to said actuating coil including the step of establishing the width of the drive pulse, said step of establishing including:

i. applying voltage to said coil;

ii. measuring the magnetic induction flux in the stator;

iii. comparing the measured flux with a predetermined value; and iv. terminating application of voltage to said coil when the measured flux reaches a predetermined value, whereby the width of voltage drive pulses are automatically adapted to the motor's load and supply voltage.

* * * * *